US007313345B2

(12) United States Patent
Inaba et al.

(10) Patent No.: US 7,313,345 B2
(45) Date of Patent: Dec. 25, 2007

(54) IMAGE FORMING UNIT

(75) Inventors: Yuichiro Inaba, Kanagawa (JP); Mitsuru Ebihara, Saitama (JP); Keisuke Shinoda, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/053,941

(22) Filed: Feb. 10, 2005

(65) Prior Publication Data

US 2005/0254855 A1 Nov. 17, 2005

(30) Foreign Application Priority Data

May 14, 2004 (JP) ..... 2004-144548

(51) Int. Cl.
*G03G 21/18* (2006.01)

(52) U.S. Cl. ..... 399/113; 399/121; 399/303; 399/313

(58) Field of Classification Search ..... 399/113, 399/121, 303, 313; 198/840, 837
See application file for complete search history.

(56) References Cited

U.S. PATENT DOCUMENTS 4,432,632 A * 2/1984 Yokota ..... 399/113
4,952,989 A * 8/1990 Kawano et al. ..... 399/113
5,172,175 A * 12/1992 Sekino et al. ..... 399/299
6,088,566 A * 7/2000 Todome ..... 399/303
6,615,006 B2 * 9/2003 Michlin et al. ..... 399/90
6,920,291 B2 * 7/2005 Saitoh et al. ..... 399/49
2002/0021916 A1 * 2/2002 Wakana ..... 399/121
2003/0175056 A1 * 9/2003 Sato et al. ..... 399/302

FOREIGN PATENT DOCUMENTS

JP 2003-195729 A 7/2003
KR 1998-064765 10/1998

OTHER PUBLICATIONS

Korean Office Action, Mailing No. 9-5-2006-0123390559, Apr. 25, 2006.

* cited by examiner

*Primary Examiner*—David M. Gray
*Assistant Examiner*—Ryan D. Walsh
(74) *Attorney, Agent, or Firm*—Sughrue Mion, PLLC

(57) ABSTRACT

An image forming unit includes: an image carrier on which a latent image is formed; an intermediate transfer belt to which a toner image obtained by developing the latent image on the image carrier is transferred; plural rolls, around which the intermediate transfer belt is wrapped and stretched; and a pair of side frames for rotatably supporting the plurality of rolls. Each of the side frames includes a guide groove for guiding a shaft of at least one of the plural rolls through an opening which is open in a direction orthogonal to an axial direction of the plural rolls.

19 Claims, 8 Drawing Sheets

IMAGE FORMING UNIT

CROSS-REFERENCE TO RELATED APPLICATION

This application claims priority under 35 USC 119 from Japanese Patent Application No. 2004-144548, the disclosure of which is incorporated by reference herein.

BACKGROUND OF THE INVENTION

1. Field of the Invention

The present invention relates to an image forming unit of an image forming apparatus, to which a toner image is transferred to form an image.

2. Brief Description of the Related Art

In a conventional image forming apparatus, an image forming unit is known, which is formed by unitizing a transfer section including an image carrier (a photosensitive member), a primary transfer roll, an intermediate transfer belt, and the like, and which is formed to be attachable to and removable from a main body of the image forming apparatus (see, for example, Japanese Patent Application Laid-Open (JP-A) No. 2003-195729). This type of image forming unit includes a pair of side frames that rotatably support a primary transfer roll and other rolls, and an intermediate transfer belt is wrapped around the rolls with a predetermined tension.

Therefore, when the intermediate transfer belt is disposed, it is necessary that the last roll to be assembled (supported) is assembled to (rotatably supported by) the side frames while the last roll is pulled with a predetermined force, and this operation has been extremely troublesome. Therefore, it has conventionally been desired to improve ease of assembly of the image forming unit.

SUMMARY OF THE INVENTION

In view of the aforementioned problem, the present invention is directed to providing an image forming unit, which allows easier disposition of an intermediate transfer belt, thereby improving ease of assembly.

A first aspect of the present invention is to provide an image forming unit including: an image carrier on which a latent image is formed; an intermediate transfer belt to which a toner image obtained by developing the latent image on the image carrier is transferred; plural rolls, around which the intermediate transfer belt is wrapped and stretched; and a pair of side frames for rotatably supporting the plural rolls, wherein each of the side frames includes a guide groove for guiding a shaft of at least one of the plural rolls through an opening which is open in a direction orthogonal to an axial direction of the plural rolls.

Since each of the side frames includes a guide groove formed thereat for guiding a shaft of at least one of the plural rolls through an opening which is open in a direction orthogonal to an axial direction of the plural rolls in the above structure, assembling of the at least one roll is facilitated by the guide groove. Therefore, the intermediate transfer belt can be easily disposed, thereby improving ease of assembly of the image forming unit.

Further, a second aspect of the present invention is to provide a method of assembling an image forming unit including an image carrier on which a latent image is formed; an intermediate transfer belt to which a toner image obtained by developing the latent image on the image carrier is transferred; plural rolls, around which the intermediate transfer belt is wrapped and stretched; and a pair of side frames for rotatably supporting the plural rolls, each of the side frames including a guide groove for guiding a shaft of at least one of the plural rolls through an opening which is open in a direction orthogonal to an axial direction of the plural rolls, the method including: wrapping the intermediate transfer belt around the plural rolls; and guiding a shaft of at least one of the plural rolls to the guide groove so that the shaft is engages with and supported by the guide groove.

BRIEF DESCRIPTION OF THE DRAWINGS

Embodiments of the present invention will be described in detail with reference to the following drawings, wherein.

DETAILED DESCRIPTION OF THE INVENTION

Figure 1:
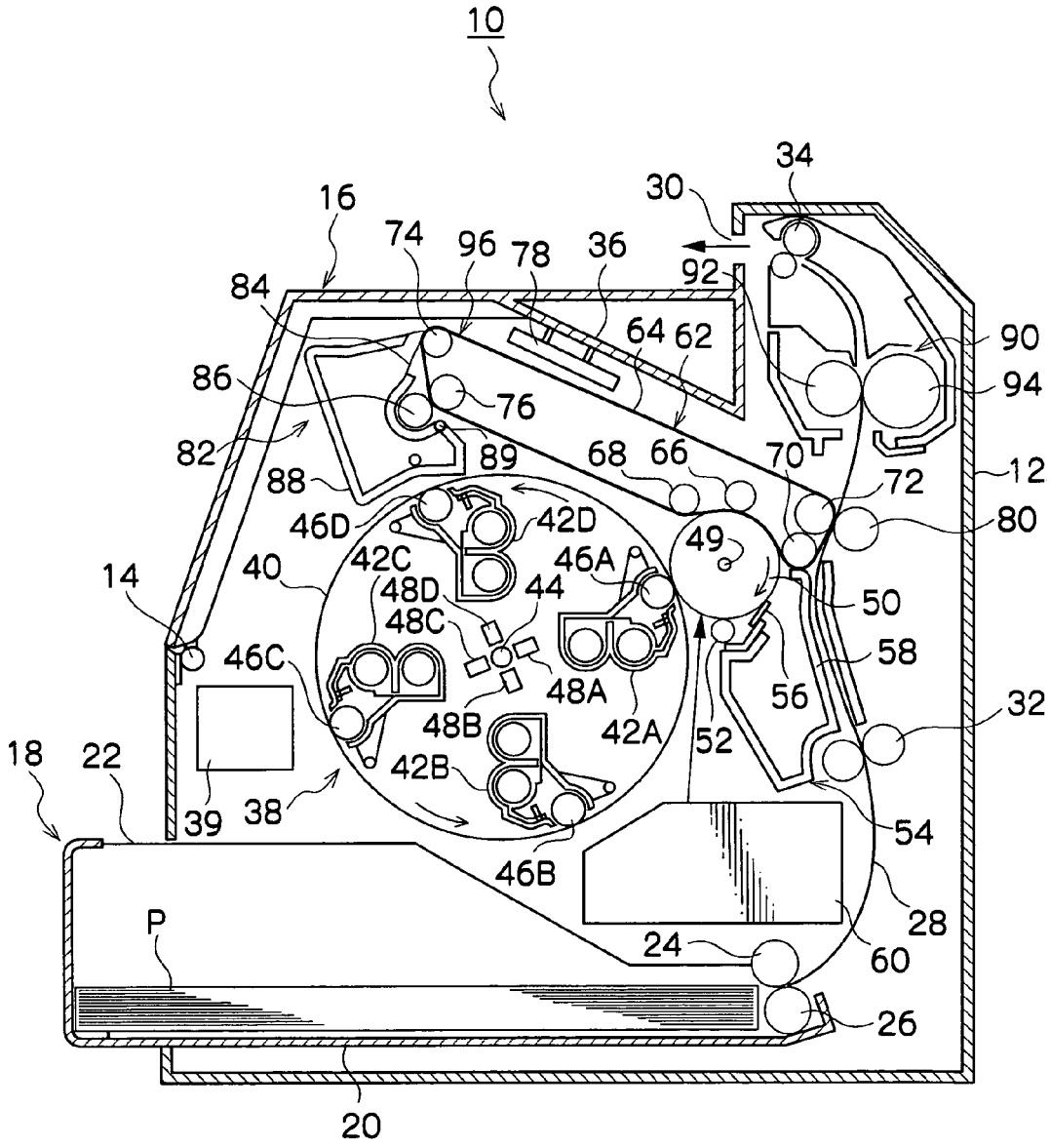
FIG. 1 is a schematic side view illustrating an image forming apparatus including an image forming unit according to an embodiment of the present invention.

Now, with respect to the best mode of the present invention, a detailed description is given based on an embodiment illustrated in the drawings. As shown in FIG. 1, an image forming apparatus 10 includes an image forming apparatus main body 12. An open/close cover 16 is disposed at an upper portion of the image forming apparatus main body 12, so as to be pivotable around a fulcrum 14. A paper feed unit 18 with, for example, a single cassette, is disposed at a lower portion of the image forming apparatus main body 12.

The paper feed unit 18 includes a paper feed unit main body 20 and a paper feed cassette 22 for accommodating sheets of recording paper P. A feed roll 24 for feeding the sheets of recording paper P from the paper feed cassette 22, and a retard roll 26 for handling the sheets of the recording paper P one by one are disposed at an upper portion of the paper feed cassette 22 in the vicinity of the innermost portion of the paper feed cassette 22.

A conveying path 28 is a path for the sheet of recording paper P conveyed from the feed roll 24 to the ejection port 30. The conveying path 28 is positioned in the vicinity of the back side (the right side surface in FIG. 1) of the image forming apparatus main body 12 and is formed substantially vertically from the paper feed unit 18 to a fixing device 90 (described later). A secondary transfer roll 80 and a secondary transfer backup roll 72 (which are described later) are disposed upstream from the fixing device 90 along the conveying path 28, and a resisting roll 32 is disposed upstream from the secondary transfer roll 80 and the secondary transfer backup roll 72. Further, an ejection roll 34 is disposed in the vicinity of the ejection port 30 along the conveying path 28.

Therefore, the sheets of recording paper P fed by the feed roll 24 from the paper feed cassette 22 of the paper feed unit 18 is handled by the retard roll 26, so that only the topmost sheet of recording paper P is guided toward the conveying path 28. Then, the sheet of recording paper P is temporarily stopped by the resisting roll 32, and is conveyed between the secondary transfer roll 80 and the secondary transfer backup roll 72 at a predetermined timing to transfer a toner image to the sheet of recording paper P. The transferred toner image is fixed by the fixing device 90, and is ejected by the ejection roll 34 from the ejection port 30 to an ejection section 36, which is provided at the top of the open/close cover 16. The ejection section 36 is inclined so that a portion thereof near the ejection port is lower and the height thereof is gradually increased toward the front side (the left side in FIG. 1).

A rotary developing device 38 is disposed in the image forming apparatus main body 12 at, for example, the substantially central portion thereof. Further, a controlling unit 39 for controlling each section forming the image forming apparatus 10 is disposed in front of the rotary developing device 38 (the left side in FIG. 1). The rotary developing device 38 includes developers 42A to 42D, which respectively form toner images of four colors including yellow, magenta, cyan and black, within a rotating member 40. The rotary developing device 38 rotates left-handedly (counterclockwise in FIG. 1) around an axis of rotation 44. The developers 42A to 42D respectively include corresponding one of developer rolls 46A to 46D, and are pressed by resilient members, such as coil springs, 48A to 48D respectively in a direction normal to the rotating member 40.

An image carrier 50 formed by a photosensitive member, which rotates around, for example, a supporting shaft 49, is disposed so as to abut on the rotary developing device 38. In a state of not abutting on the image carrier 50, outer circumference portions of the developer rolls 46A to 46D partially project beyond the outer circumference of the rotating member 40 in a radial direction by, for example, 2 mm. Further, each of opposite ends of the developer rolls 46A to 46D is provided with a tracking roll (not shown), which has a diameter slightly larger than a diameter of the developer rolls 46A to 46D and which rotates coaxially with corresponding one of the developer rolls 46A to 46D.

In other words, the developers 42A to 42D are disposed along the outer circumference of the rotating member 40 at an interval of 90 degrees around the axis of rotation 44, and the tracking rolls of the developer rolls 46A to 46D abut on flanges (not shown) provided at opposite ends of the image carrier 50 so that a predetermined clearance is formed between each of the developer rolls 46A to 46D and the image carrier 50 while a latent image on the image carrier 50 is developed with toner of each color.

A charging device 52 including, for example, a charging roll for uniformly charging the image carrier 50 is disposed below the image carrier 50. The image carrier 50 is provided with an image carrier cleaner 54 that is disposed so as to be hung from the supporting shaft 49. The image carrier 50 and the image carrier cleaner 54 are united together.

The image carrier cleaner 54 includes a cleaning blade 56 for scraping waste toner remaining on the image carrier 50 after, for example, primary transfer, and a toner collection bottle 58 for collecting the waste toner scraped by the cleaning blade 56. It should be noted that, the back side (the right side in FIG. 1) of the toner collection bottle 58 is provided with a rib or the like formed thereon, and is curved so that the sheet of recording paper P can be smoothly conveyed, forming a portion of the conveying path 28.

An exposure device 60 for writing a latent image with a light beam, such as a laser beam, on the image carrier 50, which has been charged by the charging device 52, is disposed below and behind the rotary developing device 38. An intermediate transfer device 62 for conveying the toner image, which has been visualized by the rotary developing device 38, from a primary transfer position to a secondary transfer position is disposed above the rotary developing device 38.

The intermediate transfer device 62 includes an intermediate transfer belt 64 that serves as an intermediate transfer member, a primary transfer roll 66, a wrap-in roll 68, a wrap-out roll 70, a secondary transfer backup roll 72, a scraper backup roll 74 and a brush backup roll 76. The intermediate transfer belt 64 is, for example, elastic, and is stretched to be substantially flat and to have long sides and short sides above the rotary developing device 38.

The upper long side of the intermediate transfer belt 64 is stretched to be substantially parallel to the ejection section 36 that is provided, for example, at the upper portion of the image forming apparatus main body 12. Further, the intermediate transfer belt 64 includes a primary transfer area (an image carrier wrapping area), which contacts the image carrier 50 so as to wrap the image carrier 50 between the wrap-in roll 68 disposed upstream from the primary transfer roll 66 and the wrap-out roll 70 disposed downstream from the primary transfer roll 66 at the lower long side of the intermediate transfer belt 64. The primary transfer area wraps around the image carrier 50 by a predetermined range and moves along with rotation of the image carrier 50.

Thus, the toner image on the image carrier 50 is primarily transferred by the primary transfer roll 66 to the intermediate transfer belt 64 to be overlapped in the order of, for example, yellow, magenta, cyan and black. Thereafter, the primarily transferred toner image is conveyed toward a secondary transfer roll 80 (described later). It should be noted that, at this time, the wrap-in roll 68 and the wrap-out roll 70 are spaced apart from the image carrier 50.

In this manner, the intermediate transfer belt 64 is stretched (disposed) around five rolls including the wrap-in roll 68, the wrap-out roll 70, the secondary transfer backup roll 72, the scraper backup roll 74 and the brush backup roll, and the toner image on the image carrier 50 is transferred thereto by the primary transfer roll 66.

Further, a flat portion (the short side) is formed at the back side (the right side surface in FIG. 1) of the intermediate transfer belt 64 by the wrap-out roll 70 and the secondary transfer backup roll 72. The flat portion is formed to serve as a secondary transfer area and faces the conveying path 28. It should be noted that the wrap-out roll 70 is disposed so that an angle of, for example, 12 degrees is formed between the intermediate transfer belt 64 and the conveying path 28 at the secondary transfer area.

The scraper backup roll 74 assists a scraper 84 (described later) in scraping the waste toner remaining on the intermediate transfer belt 64 after secondary transfer. The brush backup roll 76 assists a brush roll 86 (described later) in scraping the waste toner remaining on the intermediate transfer belt 64 after the secondary transfer.

A sensor 78, such as a reflective photosensor, is disposed above the upper long side of the intermediate transfer belt 64, by being fixed on the back surface (the inner side) of the open/close cover 16. The sensor 78 reads a toner patch forms on the intermediate transfer belt 64 to detect the position of the intermediate transfer belt 64 in the rotational direction thereof and to detect toner density.

The secondary transfer backup roll 72 of the intermediate transfer device 62 faces the secondary transfer roll 80 via the conveying path 28. In other words, a position between the secondary transfer roll 80 and the secondary transfer backup roll 72 is a secondary transfer position in the secondary transfer area. With assistance of the secondary transfer backup roll 72, the secondary transfer roll 80 secondarily transfers the toner image, which has been primarily transferred to the intermediate transfer belt 64, to the sheet of recording paper P at the secondary transfer position.

While the intermediate transfer belt 64 rotates three times, that is, toner images of three colors including yellow, magenta and cyan are conveyed, the secondary transfer roll 80 is spaced apart from the intermediate transfer belt 64, and when the black toner image has been transferred, the secondary transfer roll 80 abuts on the intermediate transfer belt 64. It should be noted that the secondary transfer roll 80 and the secondary transfer backup roll 72 are formed to have a predetermined potential difference therebetween and, for example, when the secondary transfer roll 80 is set at a high voltage, the secondary transfer backup roll 72 is connected to a ground (GND), or the like.

An intermediate transfer member cleaner 82 is disposed so as to abut on an end of the short side of the intermediate transfer belt 64 opposite from another end thereof near the image carrier 50. The intermediate transfer member cleaner 82 includes a scraper 84, a brush roll 86, a toner collection bottle 88 and a supporting shaft 89. The intermediate transfer member cleaner 82 pivots around the supporting shaft 89. The scraper 84 scrapes and cleans the waste toner remaining on the intermediate transfer belt 64 after, for example, the secondary transfer. The brush roll 86 further scrapes the waste toner that remains after cleaning by the scraper 84. The toner collection bottle 88 collects the toner scraped by the scraper 84 and the brush roll 86.

The scraper 84 is made, for example, of a stainless sheet, and is applied with a voltage of a polarity opposite to that of the toner. The brush roll 86 includes an acryl brush, or the like, that has been subjected, for example, to a treatment for adding conductivity thereto. While the intermediate transfer belt 64 conveys the toner image, the scraper 84 and the brush roll 86 are spaced apart from the intermediate transfer belt 64, and at a predetermined timing, they are brought together into abutment on the intermediate transfer belt 64. It should be noted that the intermediate transfer device 62, the image carrier 50, the charging device 52, the image carrier cleaner 54 and the intermediate transfer member cleaner 82 are united to form a part of an image forming unit 96 (described later).

The fixing device 90 is disposed above the secondary transfer position. The fixing device 90 includes a heat roll 92 and a pressure roll 94, and fixes the toner image, which has been secondarily transferred by the secondary transfer roll 80 and the secondary transfer backup roll 72 to the sheet of recording paper P, to the recording paper P, and conveys the sheet of recording paper P toward the ejection roll 34.

Figure 2:
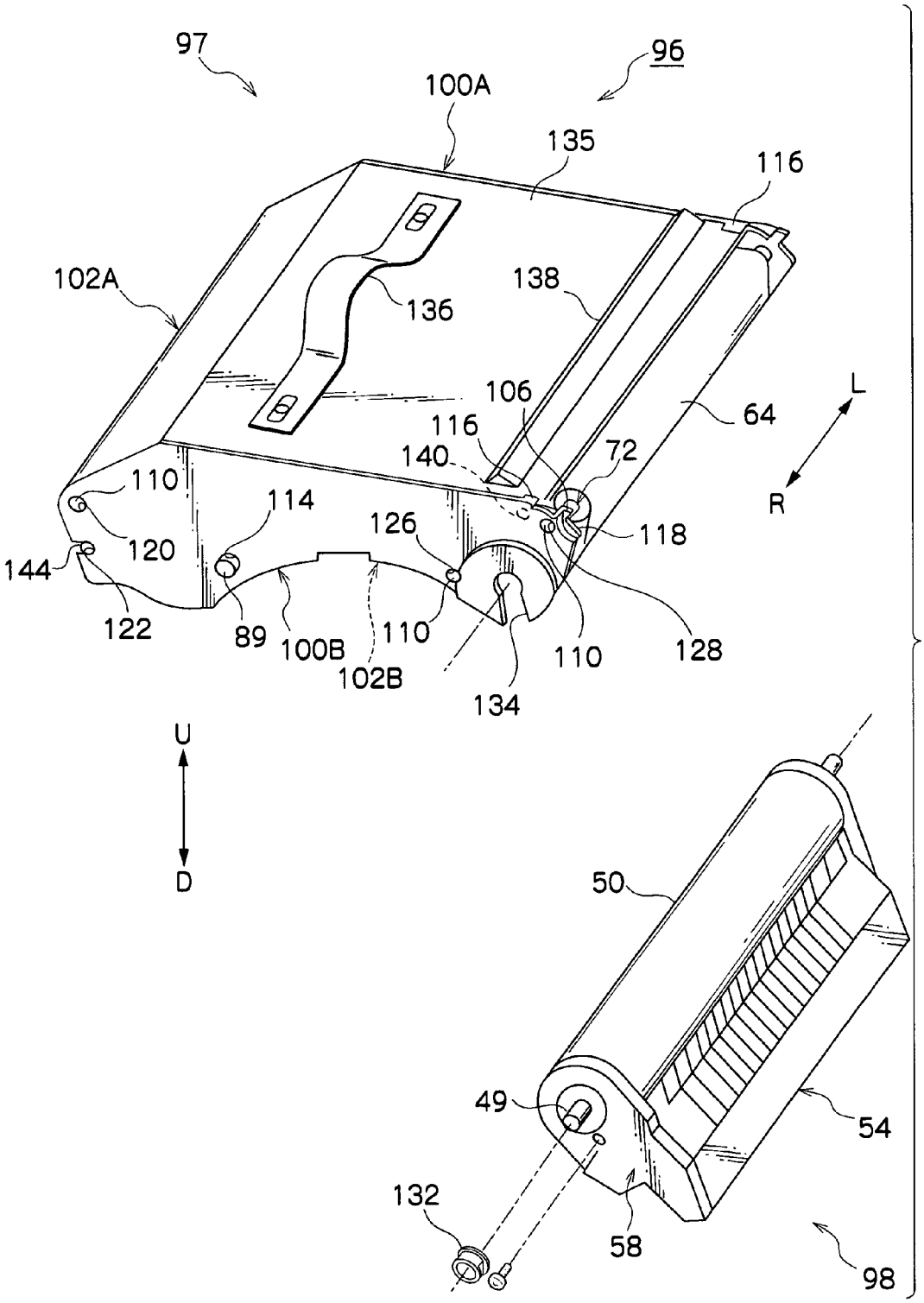
FIG. 2 is a schematic perspective view illustrating the image forming unit of FIG. 1.
Figure 3:
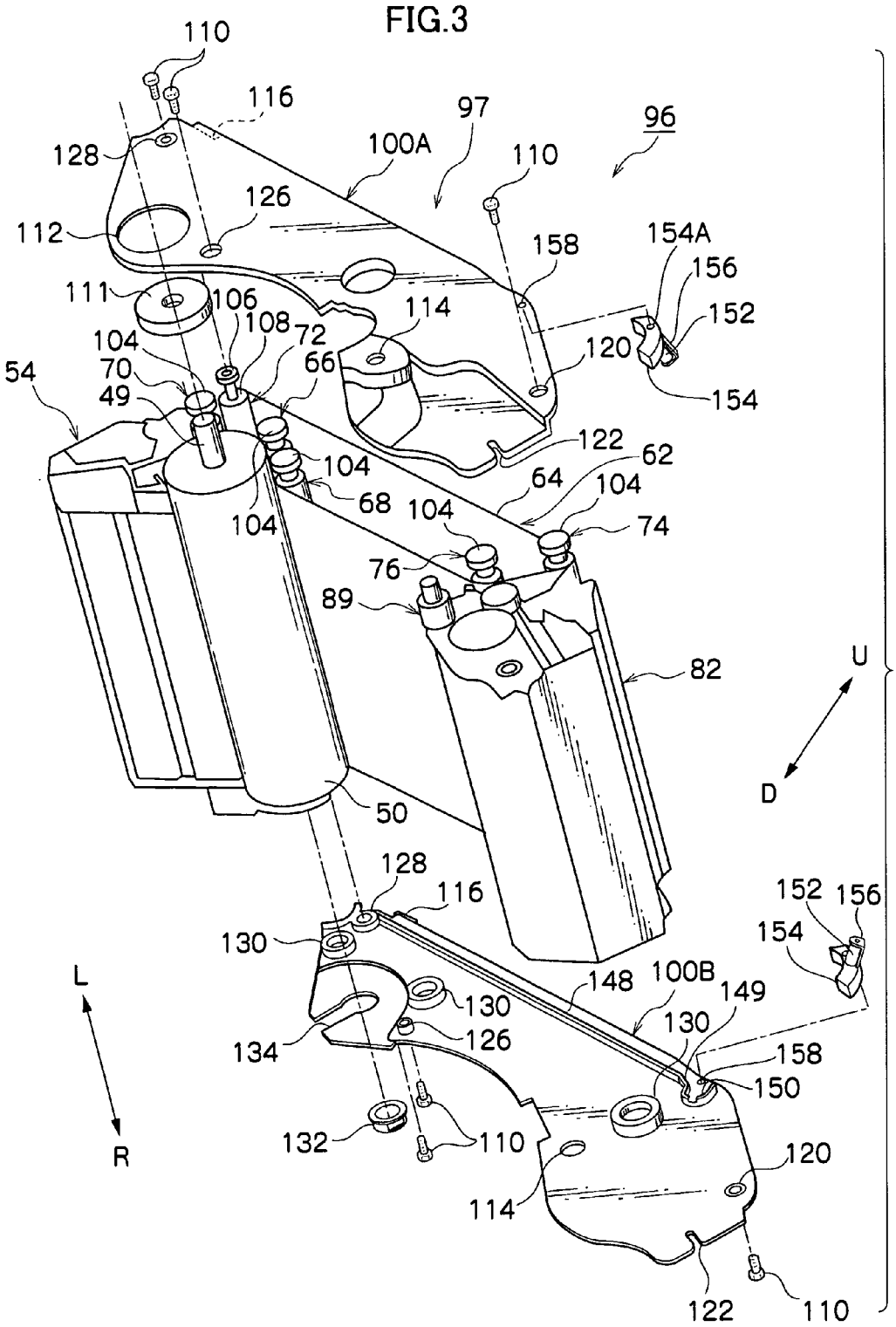
FIG. 3 is an exploded perspective view illustrating a part of the image forming unit of FIG. 1.

As shown in FIGS. 2 and 3, the image forming unit 96 is formed by a pair of side frames 100A and 100B disposed at right and left sides (shown by arrow L and arrow R), a pair of protective covers 102A and 102B disposed at upper and lower sides (shown by arrow U and arrow D), the intermediate transfer device 62, the image carrier 50, the charging device 52, the image carrier cleaner 54 and the intermediate transfer member cleaner 82, which are united together.

It should be noted that the side frames 100A and 100B, the protective covers 102A and 102B, the intermediate transfer device 62 and the intermediate transfer member cleaner 82 are unified together to form an intermediate transfer assembly 97. Further, the image carrier 50, the charging device 52 and the image carrier cleaner 54 are unified together to form an image carrier unit 98. The image carrier unit 98 is assembled to the intermediate transfer assembly 97 via bearings 111 and 132 to form the image forming unit 96.

Further, the image carrier unit 98 is formed to be attachable to and removable from the intermediate transfer assembly 97. When image carrier unit 98 is attached to the intermediate transfer assembly 97, the portion of the intermediate transfer belt 64 between the wrap-in roll 68 and the wrap-out roll 70 is wrapped around the image carrier 50 by a predetermined range. This applies a predetermined tension to the intermediate transfer belt 64, and the primary transfer area is formed between the intermediate transfer belt 64 and the image carrier 50.

The intermediate transfer belt 64 is rotatably supported by the five rolls including the secondary transfer backup roll 72, the wrap-in roll 68, the wrap-out roll 70, the scraper backup roll 74 and the brush backup roll 76. The toner image carried by the image carrier 50 is transferred to the intermediate transfer belt 64 by the primary transfer roll 66.

Each of the primary transfer roll 66, the wrap-in roll 68, the wrap-out roll 70, the scraper backup roll 74 and the brush backup roll 76 is provided with bearings 104 at opposite ends thereof, and they are supported by the side frames 100A and 100B via the bearings 104. The secondary transfer backup roll 72 includes a shaft 106 and a rotating portion 108 that rotates around the shaft 106. The rotating portion 108 is provided with bearings (not shown) at opposite ends thereof. The shaft 106 of the secondary transfer backup roll 72 is secured to the side frames 100A and 100B at opposite ends thereof with securing members 110 such as screws.

The side frame 100A includes a hole 112 which passes the supporting shaft 49 of the image carrier 50 therethrough and supports one end of the supporting shaft 49 via the bearing 111, and a hole 114 which passes the supporting shaft 89 of the intermediate transfer member cleaner 82 therethrough. The supporting shaft 49 and the supporting shaft 89 project laterally from the side frame 100A.

The side frame 100A is provided with a depression 116 at the upper portion thereof near the image carrier 50, and a protrusion 140 of the protective cover 102A engages with the depression 116. The side frame 100A is further provided with a hole 120 at the upper portion thereof near the intermediate transfer member cleaner 82, and a securing portion (not shown) of the protective cover 102A is secured to the hole 120 with the securing member 110. The side frame 100A is further provided with a depression 122 at the lower portion thereof near the intermediate transfer member cleaner 82, and a protrusion (not shown) of the protective cover 102B engages with the depression 122. The side frame 100A is also provided with a hole 126 at the lower portion thereof near the image carrier 50, and a securing portion (not shown) of the protective cover 102B is secured with the securing member 110.

In addition, the side frame 100A is provided with a securing portion 128, to which one end of the shaft 106 of the secondary transfer backup roll 72 is secured with the securing member 110. The side frame 100A is also provided with receiving portions 130 at the inner side thereof, which laterally supports one ends of the wrap-in roll 68, the wrap-out roll 70, the scraper backup roll 74 and the brush backup roll 76 via the bearings 104. It should be noted that one end of the primary transfer roll 66 is supported by the side frame 100A via the bearing 104 and a holder (not shown).

The side frame 100B includes a cutout 134 which passes the supporting shaft 49 of the image carrier 50 therethrough and supports one end of the supporting shaft 49 via the bearing 132, and a hole 114 which passes the supporting shaft 89 of the intermediate transfer member cleaner 82 therethrough. The supporting shaft 49 and the supporting shaft 89 project laterally from the side frame 100B. It should be noted that the cutout 134 is formed such that a portion thereof where the supporting shaft 49 passes through is narrower than a portion thereof where the bearing 132 is attached. The bearing 132 is secured to the side frame 100B by a securing member such as a screw (not shown).

The side frame 100B is provided with a depression 116 at the upper portion thereof near the image carrier 50, and a protrusion 140 of the protective cover 102A engages with the depression 116. The side frame 100B is further provided with a hole 120 at the upper portion thereof near the intermediate transfer member cleaner 82, and a securing portion (not shown) of the protective cover 102A is secured to the hole 120 with the securing member 110. The side frame 100B is further provided with a depression 122 at the lower portion thereof near the intermediate transfer member cleaner 82, and a protrusion (not shown) of the protective cover 102B engages with the depression 122. The side frame 100B is also provided with a hole 126 at the lower portion thereof near the image carrier 50, and a securing portion (not shown) of the protective cover 102B is secured with the securing member 110.

In addition, the side frame 100B is provided with a securing portion 128, to which one end of the shaft 106 of the secondary transfer backup roll 72 is secured with the securing member 110. The side frame 100B is also provided with receiving portions 130 at the inner side thereof, which laterally supports one ends of the wrap-in roll 68, the wrap-out roll 70, the scraper backup roll 74 and the brush backup roll 76 via the bearings 104. It should be noted that one end of the primary transfer roll 66 is supported by the side frame 100B via the bearing 104 and a holder (not shown).

The protective cover 102A includes a cover main body 135, a grip 136, a projecting portion 138, protrusions 140 and securing portions (not shown). The cover main body 135 is made, for example, of an ABS resin, and is elastic, and covers the intermediate transfer belt 64 and the intermediate transfer member cleaner 82 from above. The grip 136 is made, for example, of a flexible member, and is disposed on a top surface of the cover main body 135 so that an operator can hold the image forming unit 96.

The projecting portion 138 is formed, for example, integrally with the cover main body 135, and projects toward the fixing device 90 to prevent, if any, foreign matter on the cover main body 135 from entering the image forming apparatus main body 12. Each of the protrusions 140 engages with corresponding one of the depressions 116 of the side frames 100A and 100B. Each of the securing portions is secured to corresponding one of the holes 120 of the side frames 100A and 100B by the securing member 110.

The side frames 100A and 100B are positioned substantially parallel to the rotational direction of the image carrier 50 and the intermediate transfer belt 64, and are coupled to each other at three points via the protective covers 102A and 102B, which cover the intermediate transfer belt 64 from above and from below respectively, and the shaft 106 of the secondary transfer backup roll 72. In this manner, the parts forming the image forming unit 96 are positioned relative to each other, and sides of the image carrier 50, the intermediate transfer device 62 and the intermediate transfer member cleaner 82 are covered.

In the image forming unit 96, the opposite ends of the shaft 106 of the secondary transfer backup roll 72 are secured to the side frames 100A and 100B, and therefore, an area in the vicinity of the secondary transfer position of the intermediate transfer belt 64 is exposed in a stable state. Therefore, positioning portions 118 are formed at areas of the side frames 100A and 100B in the vicinity of the secondary transfer position, where abutting members (not shown), which are loosely fit at opposite ends of the shaft of the secondary transfer roll 80, abut on, so that a pressing force from the secondary transfer roll 80 can be appropriately received. This stabilizes a nip pressure between the secondary transfer roll 80 and the secondary transfer backup roll 72.

When the image forming unit 96 is assembled, the intermediate transfer belt 64 is manually disposed. At this time, the scraper backup roll 74 is the last to be rotatably supported thereto. That is, as shown in FIGS. 3 and 4, each of the side frames 100A and 100B includes a guide rib 148, which has substantially the same width as the thickness of the bearing 104 and is parallel to the upper end surface of each frame, formed in the vicinity of the upper end of each frame. Further, at an area of each frame supporting the scraper backup roll 74, a guide groove 150, which has a substantial "U" shape that is open in a direction orthogonal to an axial direction of the scraper backup roll 74, is formed continuously with the guide rib 148.

Furthermore, a guide wall 149, which is inclined at a predetermined angle, is formed at an end of the opening 150A of the guide groove 150 near the guide rib 148, i.e., at a portion connecting the guide rib 148 and the guide groove 150. Therefore, as the bearing 104 of the scraper backup roll 74 is slid in a direction of arrow A (see FIG. 4A) on the guide rib 148 while the intermediate transfer belt 64 is pulled from the side of the secondary transfer backup roll 72, the bearing 104 is smoothly guided into the guide groove 150.

In other words, the bearing 104 of the scraper backup roll 74 is smoothly guided by the guide wall 149 from the opening 150A into the guide groove 150, and engages with and is support by the guide groove 150. It should be noted that the opening 150A of the guide groove 150 is formed to be oriented in a direction other than a direction of a vector of a force (a direction of arrow B in FIG. 4C) applied to the scraper backup roll 74 (the bearing 104) by the tension of the intermediate transfer belt 64.

Figure 5:
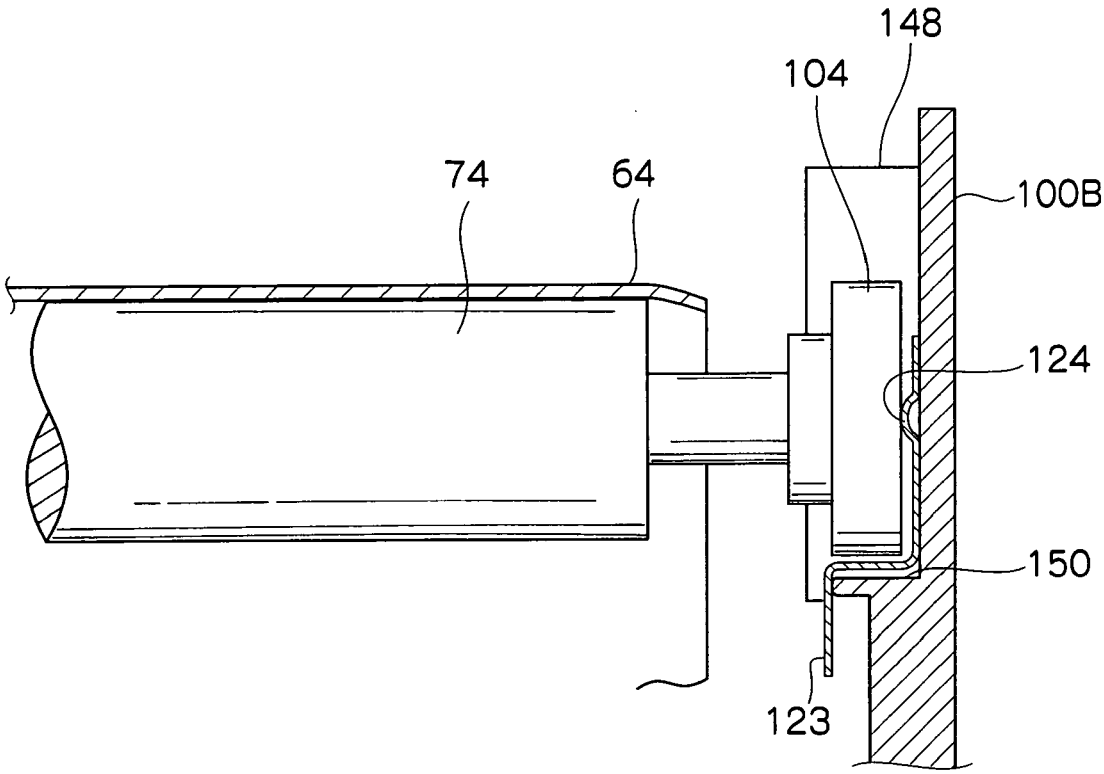
FIG. 5 is an explanatory view illustrating a contact terminal of the image forming unit of FIG. 1.

Further, as shown in FIG. 5, a contact terminal 124 for feeding electricity to the scraper backup roll 74 is disposed in the guide groove 150. The contact terminal 124 is formed by projecting a predetermined site of a metal plate 123 in the vicinity of an end thereof inward with respect to the image forming unit 96 by a predetermined height.

Figure 6:
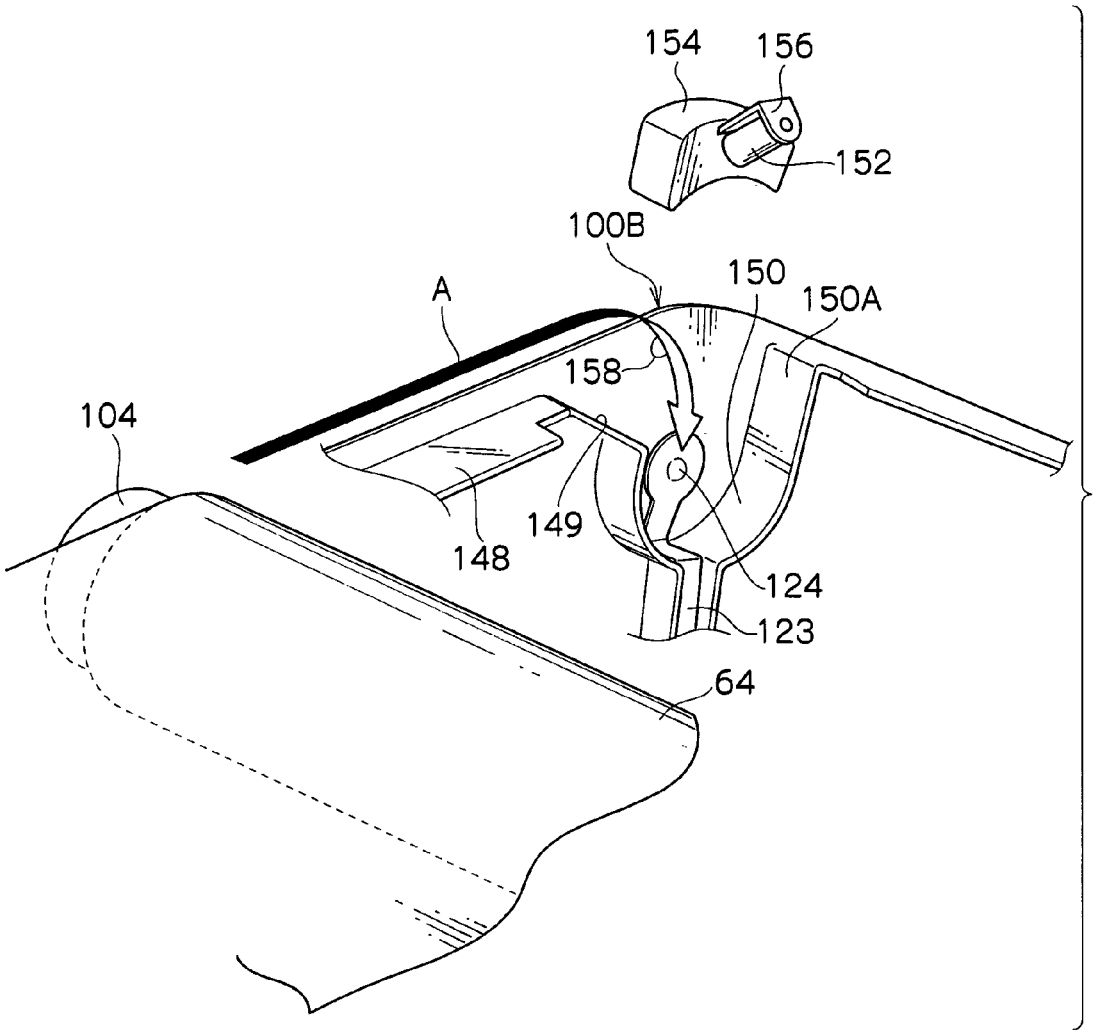
FIG. 6 is a schematic perspective view illustrating the process of disposing the intermediate transfer belt of the image forming unit of FIG. 4A.
Figure 7:
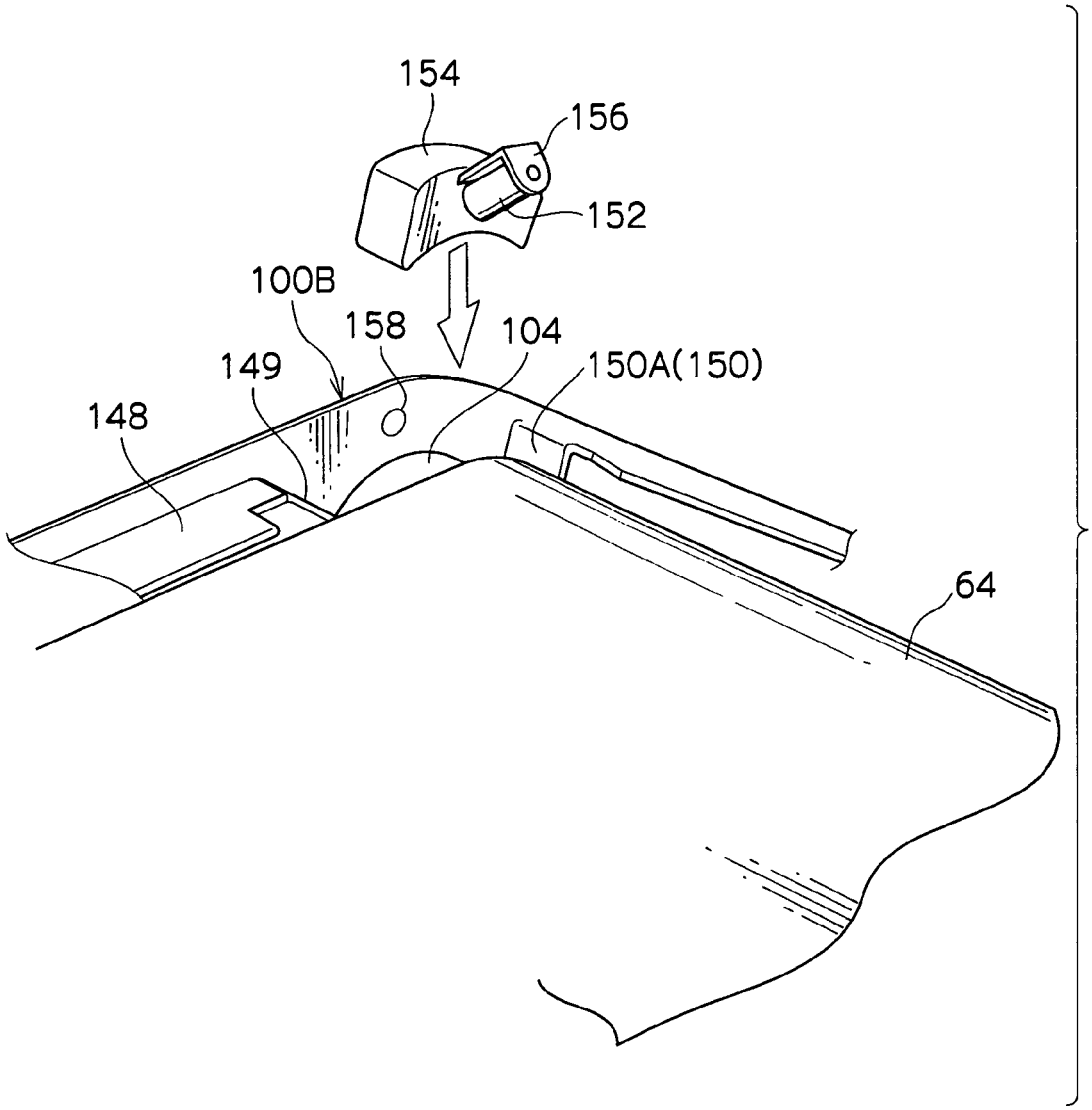
FIG. 7 is a schematic perspective view illustrating a process of attaching a straightening roller of the image forming unit of FIG. 4B.
Figure 8:
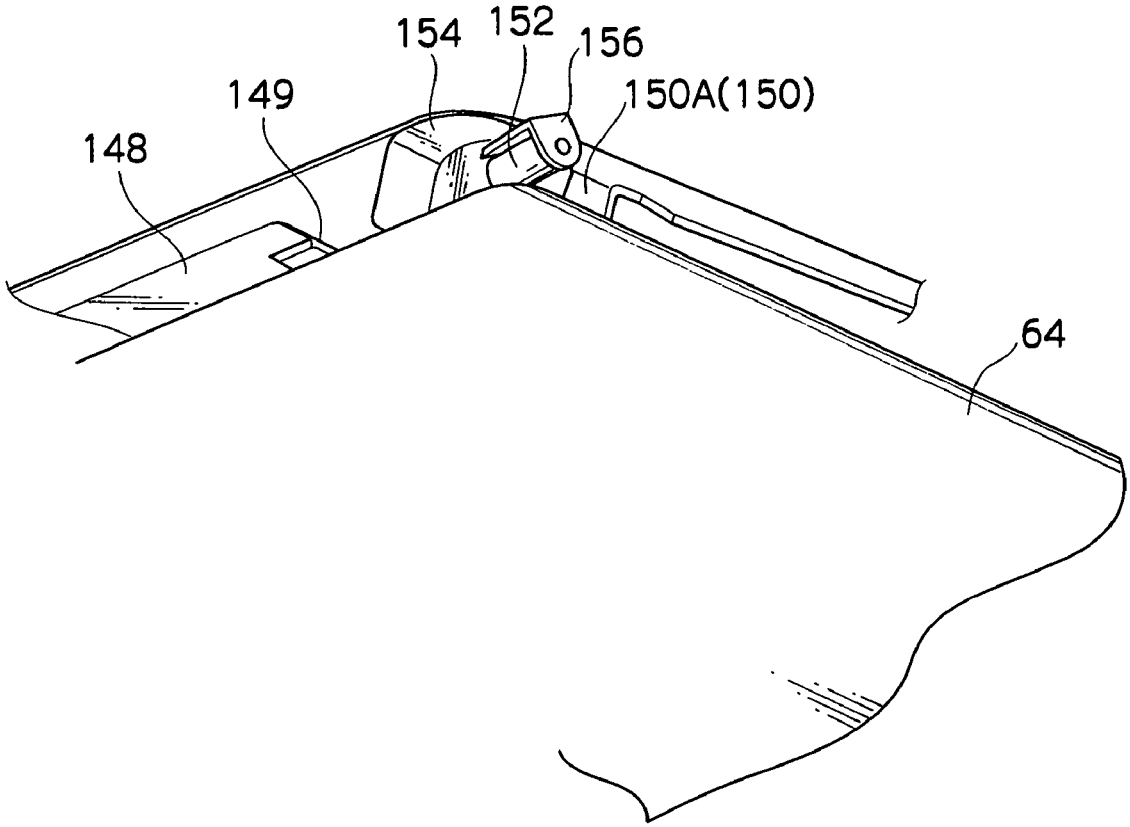
FIG. 8 is a schematic perspective view illustrating a state where the straightening roller of the image forming unit of FIG. 4C is attached.

As shown in FIGS. 6 to 8, after the bearing 104 is engaged with and supported by the guide groove 150, an attaching member 154 including a straightening roller 152, which prevents the intermediate transfer belt 64 from meandering, is attached to the upper end within the guide groove 150 of each of the side frames 100A and 100B by a screw, or the like.

The straightening roller 152 is rotatably supported by a bracket 156, which is attached to the attaching member 154 at a predetermined angle, and abuts on an area in the vicinity of each edge of the intermediate transfer belt 64 to prevent the intermediate transfer belt 64 from meandering in the axial direction thereof. It should be noted that a lower surface of the attaching member 154 is formed to have a circular arc shape when viewed from side, so as to conform to the shape of the bearing 104. Further, a screw hole 158 for securing the attaching member 154 with a screw is formed at the upper end within the guide groove 150 of each of the side frames 100A and 100B. The attaching member 154 is also provided with a screw hole 154A.

Next, operation of the image forming apparatus 10 having a structure as described above is described. As an image-forming signal is sent to the image forming apparatus 10, the image carrier 50 is uniformly charged by the charging device 52. Then, a light beam is emitted on the charged image carrier 50 from the exposure device 60 based on the image signal. The light beam from the exposure device 60 exposes the surface of the image carrier 50, thereby forming a latent image.

The latent image, which has been formed on the image carrier 50 by the exposure device 60, is developed by the rotary developing device 38 to form each of yellow, magenta, cyan and black toner images. Then, each of developed toner images is primarily transferred to the intermediate transfer belt 64 to be sequentially overlapped. Waste toner remaining on the image carrier 50 after the primary transfer is scraped by the image carrier cleaner 54 and is collected.

Meanwhile, in response to a paper-feeding signal, or the like, the sheets of recording paper P accommodated in the paper feed cassette 22 are fed out by the feed roll 24 and handled by the retard roll 26 to be guided one by one toward the conveying path 28, and is temporarily stopped by the resisting roll 32. Then, at a predetermined timing, the sheet of recording paper P is guided to enter between the secondary transfer roll 80 and the secondary transfer backup roll 72.

As the sheet of recording paper P has been guided to enter between the secondary transfer roll 80 and the secondary transfer backup roll 72, the toner image, which has been primarily transferred to the intermediate transfer belt 64, is secondarily transferred to the sheet of recording paper P by the secondary transfer roll 80 and the secondary transfer backup roll 72. Waste toner remaining on the intermediate transfer belt 64 after the secondary transfer is scraped by the intermediate transfer member cleaner 82 and is collected.

The sheet of recording paper P carrying the transferred toner image is guided to the fixing device 90, where the toner image is fixed by heat and pressure applied by the heat roll 92 and the pressure roll 94. Subsequently, the sheet of recording paper P carrying the fixed toner image is ejected through the ejection port 30 to the ejection section 36 by the ejection roll 34.

Next, a method of attaching and removing the image forming unit 96 is described. In order to remove the image forming unit 96 from the image forming apparatus main body 12, the open/close cover 16 of the image forming apparatus main body 12 of the image forming apparatus 10 is pivoted around the fulcrum 14 to open the upper portion of the image forming apparatus main body 12.

The image forming unit 96 is positioned so that the intermediate transfer device 62 and the image carrier 50 are positioned between the fixing device 90 and the rotary developing device 38. The image forming unit 96 is removed through a space between the fixing device 90 and the rotary developing device 38 in a diagonally forward direction from the image forming apparatus main body 12 (the diagonally upward and leftward direction in FIG. 1). In this manner, the image forming unit 96 can be removed without opening the conveying path 28.

In addition, the image forming unit 96 is formed to be attached and removed in a predetermined direction with respect to the image forming apparatus main body 12 by an operator holding the grip 136. The grip 136 is formed such that, when the operator holds the grip 136, for example, from above, the image forming unit 96 assumes a position suitable for insertion into the image forming apparatus main body 12. In other words, when the operator holds the grip 136 and lifts the image forming unit 96, the image forming unit 96 is inclined with the image carrier cleaner 54 being at a lower position.

As described above, the image forming unit 96 is attachable to and removable from the image forming apparatus main body 12. When the image forming unit 96 is attached to the image forming apparatus main body 12, the open/close cover 16 is opened. Further, the image carrier unit 98 is attached to or removed from the intermediate transfer assembly 97 in a state where the image forming unit 96 has been removed from the image forming apparatus main body 12.

Next, a method of disposing the intermediate transfer belt 64 around the rolls 68 to 76 in the image forming unit 96 is described. In order to dispose the intermediate transfer belt 64, first, the intermediate transfer belt 64 is placed around the plural rolls, i.e., the wrap-in roll 68, the wrap-out roll 70, the secondary transfer backup roll 72 and the brush backup roll 76.

Figure 4A:
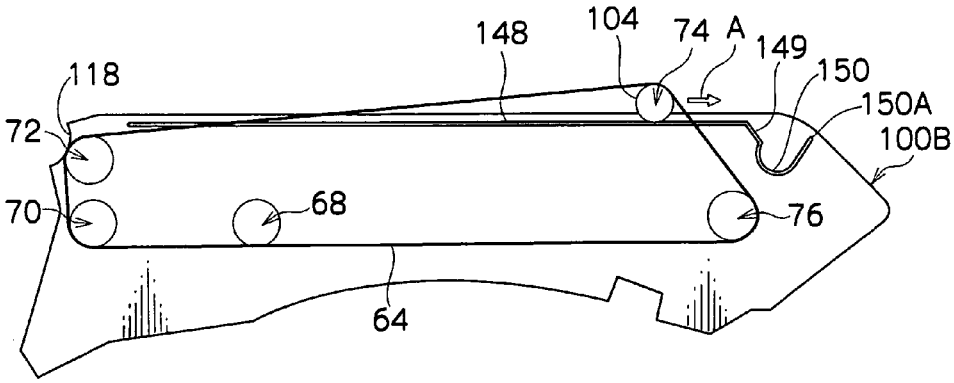
FIG. 4A is an explanatory view illustrating a process of disposing an intermediate transfer belt of the image forming unit of FIG. 1.

Finally, the intermediate transfer belt 64 is placed on the scraper backup roll 74, and an operator holds the bearing 104 (the shaft) of the scraper backup roll 74 to move the bearing 104 along the guide rib 148 in the direction of arrow A, as shown in FIGS. 4A and 6. It should be noted that, at this time, a tension is applied to the intermediate transfer belt 64, however, since this tension is smaller than a predetermined tension applied due to the image carrier 50 contacting the intermediate transfer belt 64, the intermediate transfer belt 64 can be sufficiently pulled manually by the operator.

Figure 4B:
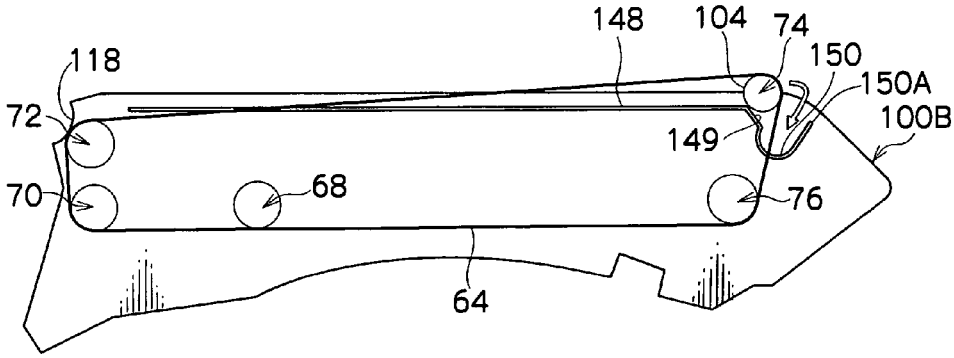
FIG. 4B is an explanatory view illustrating the process of disposing the intermediate transfer belt of the image forming unit of FIG. 1.
Figure 4C:
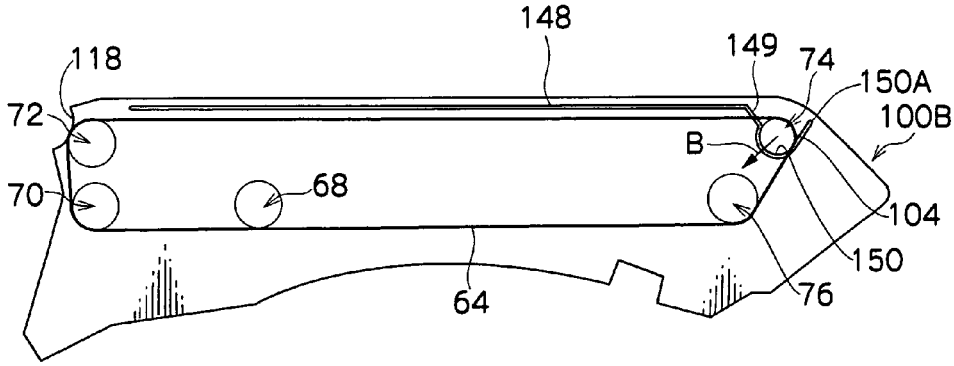
FIG. 4C is an explanatory view illustrating the process of disposing the intermediate transfer belt of the image forming unit of FIG. 1.

Subsequently, as shown in FIG. 4B, the bearing 104 is guided along the guide wall 149, and as shown in FIG. 4C, the bearing 104 is brought into engagement with the guide groove 150 and is supported by the guide groove 150. Thus, disposition of the intermediate transfer belt 64 is completed. Since the guide wall 149, which is inclined at a predetermined angle, is formed between the guide rib 148 and the guide groove 150, the bearing 104 of the scraper backup roll 74 can be easily guided into the guide groove 150 even in a state where the intermediate transfer belt 64 is tensioned.

This facilitates disposition of the intermediate transfer belt 64, and improves ease of assembly of the entire image forming unit 96. It should be noted that, the opening 150A of the guide groove 150 is oriented in a direction other than the direction of the vector of the force (the direction of arrow B) applied to the bearing 104 by the tension of the intermediate transfer belt 64 that is applied when the scraper backup roll 74 is supported by the guide groove 150, for example, in a direction opposite to the direction of arrow B (the optimal direction). Therefore, no such trouble occurs as the bearing 104 coming off from the guide groove 150. Therefore, there is no need for separately providing a holding mechanism for holding the bearing 104 to prevent coming off, and cost reduction of the image forming unit 96 can be achieved.

Further, as shown in FIGS. 5 and 6, the contact terminal 124 made of the metal plate 123 for enabling to feed electricity to the image forming unit 96 from the image forming apparatus main body 12 is disposed in the guide groove 150. The side end surface of the bearing 104 of the scraper backup roll 74 abuts only on the contact terminal 124. That is, the contact terminal 124 is formed to project inward with respect to the image forming unit 96 by a predetermined height.

Therefore, when the bearing 104 of the scraper backup roll 74 is engaged with and supported by the guide groove 150, the side end surface of the bearing 104 does not contact areas of the metal plate 123 other than the contact terminal 124. Therefore, no such trouble as the scraper backup roll 74 deforming the metal plate 123 occurs, and a good assembling property of the scraper backup roll 74 is achieved.

After the bearing 104 has been engaged with and supported by the guide groove 150, as shown in FIGS. 6 to 8, the attaching member 154 including the straightening roller 152 for preventing the intermediate transfer belt 64 from meandering is attached to the upper end of each of the side frames 100A and 100B with a screw, or the like, so as to close the opening 150A. Therefore, even if the image forming unit 96 is dropped, the bearing 104 is prevented from coming off from the guide groove 150 with certainty. Since the bearing 104 of the scraper backup roll 74 does not come off from the guide groove 150, reliability of the image forming unit 96 can be improved.

It should be noted that this type of groove 150 is not formed at a site for supporting the secondary transfer backup roll 72. This is because that, since a high pressing force is applied to the secondary transfer backup roll 72 from the secondary transfer roll 80, if the guide groove 150 for facilitating assembly is formed at that site, rigidity of the guide groove cannot be ensured. Therefore, the guide groove 150 is preferably formed at a site for supporting a roll other than the secondary transfer backup roll 72.

It is optimal that the guide groove 150 is formed at the site for supporting the scraper backup roll 74. The scraper backup roll 74 is rotatably supported at the upper ends of the side frames 100A and 100B, and a wrap angle (a wrap length) of the intermediate transfer belt 64 with respect to the scraper backup roll 74 is greater (the greatest) than wrap angles with respect to the other rolls including the wrap-in roll 68, the wrap-out roll 70, the secondary transfer backup roll 72 and the brush backup roll 76. Therefore, by setting the scraper backup roll 74 as a final assembly roll that is assembled at the last, an operator can pull the intermediate transfer belt 64 manually with ease.

In addition, a virtual length of the intermediate transfer belt 64 when it is wrapped around the rolls other than the scraper backup roll 74, i.e., around the wrap-in roll 68, the wrap-out roll 70, the secondary transfer backup roll 72 and the brush backup roll 76, is smaller than a natural length of the intermediate transfer belt 64. Therefore, a tension that is applied when the intermediate transfer belt 64 is disposed with the scraper backup roll 74 being pulled is relatively small. With this structure, the tension applied during disposition of the intermediate transfer belt 64 is reduced from that with a conventional structure, and therefore, manual disposition of the intermediate transfer belt 64 is facilitated.

As described above, anyhow, the guide groove 150 for guiding and supporting the bearing 104 of the scraper backup roll 74 is formed at the site for supporting the scraper backup roll 74, which is one of the rolls other than the secondary transfer backup roll 72, at the upper end of each of the side frames 100A and 100B, manual disposition of the intermediate transfer belt 64 is facilitated. Therefore, improvement in ease of assembly of the image forming unit 96 can be achieved.

Further, in the image forming unit of the present invention, the guide groove is formed at the upper end of each of the side frames. Since the guide groove is formed at the upper end of each of the side frames, the intermediate transfer belt can be disposed with ease. Therefore, improvement in ease of assembly of the image forming unit can be achieved.

Furthermore, the guide groove is formed for the shaft of the final assembly roll that is assembled to the side frames while at least the intermediate transfer belt is pulled. Since the guide groove is formed for the shaft of the final assembly roll that is assembled to the side frames while at least the intermediate transfer belt is pulled, the intermediate transfer belt can be disposed with ease. Therefore, improvement in ease of assembly of the image forming unit can be achieved.

Moreover, the wrap angle of the intermediate transfer belt with respect to the final assembly roll is the greatest of all. Since the wrap angle of the intermediate transfer belt with respect to the final assembly roll is the greatest of all, the intermediate transfer belt can be appropriately pulled. Therefore, the intermediate transfer belt can be disposed very easily, and therefore, improvement in ease of assembly of the image forming unit can be achieved.

In addition, the guide groove is formed to have a substantial "U" shape when viewed from side, and the opening thereof is oriented in a direction other than the direction of the force applied to the shaft due to the tension of the intermediate transfer belt applied to the final assembly roll. Since the opening of the guide groove is oriented in a direction other than the direction of the force applied to the shaft thereof due to the tension of the intermediate transfer belt applied to the final assembly roll, the final assembly roll does not come off from the guide groove. Therefore, there is no need for separately providing a holding mechanism, or the like, thereby achieving cost reduction.

Further, the guide wall for guiding the shaft of the final assembly roll is formed at the end of the opening of the guide groove at the side from which the final assembly roll comes. Since the guide wall for guiding the shaft of the final assembly roll is formed at the end of the opening of the guide groove at the side from which the final assembly roll comes, the final assembly roll can be guided smoothly to the guide groove by the guide wall. Therefore, the intermediate transfer belt can be disposed very easily, thereby achieving improvement in ease of assembly of the image forming unit.

Furthermore, the opening of the guide groove is closed with the member including the straightening roller for preventing the intermediate transfer belt from meandering. Since the opening of the guide groove is closed with the member including the straightening roller for preventing the intermediate transfer belt from meandering, even if the image forming unit is dropped, the final assembly roll can be prevented from coming off from the guide groove with certainty. Therefore, reliability of the image forming unit can be improved.

Moreover, the contact portion for feeding electricity to the final assembly roll is provided within the guide groove. Since the contact portion for feeding electricity to the final assembly roll is provided within the guide groove, ease of assembly of the image forming unit is improved.

In addition, the final assembly roll is selected from the rolls other than the secondary transfer backup roll. Since the final assembly roll is not used as the secondary transfer backup roll, the nip pressure at the secondary transfer area can be stabilized. In other words, since a high pressing force is applied to the secondary transfer backup roll from the secondary transfer roll, if a guide groove is provided at that site for facilitating assembly, rigidity of the guide groove cannot be ensured. Therefore, the secondary transfer backup roll is not selected as the final assembly roll.

Moreover, the virtual length of the intermediate transfer belt, which is wrapped around the rolls other than the final assembly roll, is smaller than the natural length of the intermediate transfer belt. Since the virtual length of the intermediate transfer belt, which is wrapped around the rolls other than the final assembly roll, is smaller than the natural length of the intermediate transfer belt, the tension of the intermediate transfer belt can be reduced. Therefore, disposition of the intermediate transfer belt can be facilitated, thereby achieving improvement in ease of assembly of the image forming unit.

As described above, according to the present invention, the image forming unit can be provided, wherein disposition of the intermediate transfer belt can be facilitated, thereby achieving improvement in ease of assembly.

What is claimed is:

1. An image forming unit comprising:

an image carrier on which a latent image is formed;

an intermediate transfer belt to which a toner image obtained by developing the latent image on the image carrier is transferred;

a plurality of rolls, around which the intermediate transfer belt is wrapped and stretched;

a pair of side frames for rotatably supporting the plurality of rolls, wherein each of the side frames includes a guide groove for guiding a shaft of at least one of the plurality of rolls through an opening which is open in a direction orthogonal to an axial direction of the plurality of rolls;

wherein the guide groove is formed for a shaft of a final assembly roll, the final assembly roll being assembled to the side frames while pulling the intermediate transfer belt;

the image forming unit further comprising an attaching member attached to the side frame so as to limit the movement of the final assembly roll;

wherein the opening of the guide groove is closed by the attaching member; and wherein a wrap angle of the intermediate transfer belt with respect to the final assembly roll is the greatest of those with respect to the plurality of rolls.

2. The image forming unit as claimed in claim 1, wherein the guide groove is formed at an upper end of each of the side frames.

3. The image forming unit as claimed in claim 1, wherein each of the side frames includes a guide rib that is continuous with the guide groove, the guide rib guiding at least one of the plurality of rolls into the guide groove.

4. The image forming unit as claimed in claim 3, wherein the guide rib projects from a surface of the frame.

5. The image forming unit as claimed in claim 4, wherein the guide rib projects from a surface of the side frame facing the intermediate transfer belt and wherein the guide rib projects in a direction towards the intermediate transfer belt.

6. The image forming unit as claimed in claim 1, wherein the guide groove is formed to have a substantial "U" shape when viewed from the side, and the opening is oriented in a direction other than a direction in which force is applied to the shaft due to tension of the intermediate transfer belt applied to the final assembly roll.

7. The image forming unit as claimed in claim 6, and the attaching member includes a straightening roller.

8. The image forming unit as claimed in claim 1, wherein a guide wall for guiding the shaft of the final assembly rolls is formed at an end of the opening of the guide groove at a side of the opening from which the final assembly roll enters.

9. The image forming unit as claimed in claim 8, wherein the guide wall is inclined.

10. The image forming unit as claimed in claim 1, wherein a contact portion for feeding electricity to the final assembly roll is provided in the guide groove.

11. The image forming unit as claimed in claim 1, wherein the final assembly roll is selected from the rolls other than a secondary transfer backup roll.

12. The image forming unit as claimed in claim 1, wherein a virtual length of the intermediate transfer belt wrapped around the rolls other than the final assembly roll is smaller than a natural length of the intermediate transfer belt.

13. An image forming apparatus comprising the image forming unit as claimed in claim 1.

14. A method of assembling an image forming unit including an image carrier on which a latent image is formed; an intermediate transfer belt to which a toner image obtained by developing the latent image on the image carrier is transferred; a plurality of rolls, around which the intermediate transfer belt is wrapped and stretched; and a pair of side frames for rotatably supporting the plurality of rolls, each of the side frames including a guide groove for guiding a shaft of at least one of the plurality of rolls through an opening which is open in a direction orthogonal to an axial direction of the plurality of rolls, the method comprising:

wrapping the intermediate transfer belt around the plurality of rolls;

guiding a shaft of at least one of the plurality of rolls into the guide groove while pulling the intermediate transfer belt so that the shaft is engaged with and supported by the guide groove; and providing an attaching member which closes the opening; and wherein the guide groove comprises, at an end of the opening thereof, a guide wall that is inclined and the guide wall guides the shaft into the guide groove.

15. The method of assembling an image forming unit as claimed in claim 14, wherein each of the side frames comprises a guide rib that is continuous with the guide wall, and the at least one of the plurality of rolls is guided along the guide rib to engage with the guide groove.

16. The method of assembling an image forming unit as claimed in claim 14, wherein the plurality of rolls comprises at least a wrap-in roll, a wrap-out roll, a secondary transfer backup roll, and a brush backup roll, and the last roll of the plurality of rolls to be assembled is assembled to the guide groove and is selected from the rolls other than the secondary transfer backup roll.

17. A method of assembling an image forming unit, comprising:

wrapping an intermediate transfer belt around a plurality of rolls; and attaching the plurality of rolls to a side frame;

wherein the last roll of the plurality of rolls attached to the side frame, is attached by guiding the roll along a guide rib into a guide groove which holds the last roll in place; and further comprising an attaching member which closes an opening of the guide groove;

wherein the wrap angle of the intermediate transfer belt around the last roll is greater than the wrap angle around the remaining rolls of the plurality of rolls.

18. The method of assembling an image forming unit as claimed in claim 17, wherein the transfer intermediate transfer belt is stretched while the last roll is attached to the side frame.

19. The method of assembling an image forming unit as claimed in claim 17, wherein the plurality of rolls comprises a wrap-in roll, a wrap-out roll, a secondary transfer backup roll, and a brush backup roll.

* * * * *